US006010270A

United States Patent [19]

Friedman

[11] Patent Number: 6,010,270

[45] Date of Patent: Jan. 4, 2000

[54] RING BINDER WITH LOCKING DEVICE

[75] Inventor: Michael N. Friedman, Seven Harbor Ct., Centerport, N.Y. 11721

[73] Assignees: Michael N. Friedman; Marcia J. Friedman, both of Centerport, N.Y.

[21] Appl. No.: 09/024,356

[22] Filed: Feb. 17, 1998

[51] Int. Cl.[7] ..... B42F 3/02; B42F 3/00; B42F 13/00

[52] U.S. Cl. ..... 402/21; 402/58; 402/20; 402/19; 402/34; 402/80 P; 402/80 R; 402/60; 402/4

[58] Field of Search ..... 402/4, 57, 58, 402/59, 60, 61, 62, 63, 64, 65, 67, 68, 70, 73, 80 R, 21; 281/19.2, 19.3, 15.1

[56] References Cited

U.S. PATENT DOCUMENTS

| | | | |
|---|---|---|---|
| 973,452 | 10/1910 | Morden et al. | 402/32 |
| 2,116,078 | 5/1938 | Mevi | 402/20 |
| 2,244,663 | 6/1941 | Adams | 402/73 |
| 2,450,785 | 10/1948 | Emmer | 402/32 |
| 2,489,706 | 11/1949 | Emmer | 402/20 |
| 4,374,627 | 2/1983 | Friedman | 402/20 |
| 4,511,274 | 4/1985 | Chen | 402/21 |
| 5,037,229 | 8/1991 | Stengel | 402/20 |

*Primary Examiner*—Willmon Fridie, Jr.
*Assistant Examiner*—Alisa Thurston
*Attorney, Agent, or Firm*—Bauer & Schaffer, LLP

[57] ABSTRACT

A ring type binder for perforated sheets or the like in which two members are coaxially secured so that a slot is formed along each longitudinal edge of the members. Another partially open ring member is provided that is configured to be slidably received in the slots so that ring member may be moved from an opened to a closed position. A locking device is provided so that the binder may be selectively locked in the closed portion, thereby preventing the unwanted shifting of the members.

9 Claims, 3 Drawing Sheets

RING BINDER WITH LOCKING DEVICE

BACKGROUND OF THE INVENTION

The present invention relates to an improved ring-type binder for binding of loose perforated sheets and the like.

In the past ring binders have been formed of a strip of cylindrically rolled plastic longitudinally split to have two opposed edges. A plurality of teeth are formed along one longitudinal edge which, rolled, overlap the other longitudinal edge forming a plurality of closed rings. The plastic used in such binders have a memory such that when the binder is flexed or bent it is biased to return to its original shape upon removal of the force. Because of the tendency of the binding elements to remain in their closed position, it is difficult to add or remove perforated sheets from the binder without damage to the binding elements or the sheets. Indeed, it was never intended that the user should normally attempt to add or remove pages without the help of a special tool.

The above described class of binding materials has come to be considered permanent for all practical purposes.

To overcome the shortcomings inherent in the devices described above, my prior patent, U.S. Pat. No. 4,374,627, disclosed a ring-type binder having two substantially smooth members being longitudinally movable relative to one another. One member, forming a closure, is provided with a raised projection at one end and an aperture at the other end. The other member, having a plurality of rings or teeth along its length, is provided with an aperture at one end and a projection at the other so that they correspond respectively to the projection and aperture of the closure member. Thus, when the members are aligned the corresponding apertures and projection engage placing the binder in a locked position. Upon application of a separating force by the user, however, the members were movable relative to one another so as to permit the insertion of additional pages.

It will be apparent that after numerous cycles wherein the members are shifted between the open and locked position, that the projections worn due the shear stress exerted thereon. In some cases, this results in the unwanted shifting of the binder members and fracturing of the projections. To improve the functional life of the binder, an improved locking device is required.

One alternative explored, but not patented, was to use one of the ring elements as the locking device by providing an orifice in the closure member for the insertion and reception of one of the plurality of teeth or rings. When inserted in the orifice the ring element prevents the relative movement of the binder members, thereby keeping the binder in a locked position. When additional papers are required, the ring element must first be removed so as to permit movement of the binder members. However, this arrangement was not without problems. If the binder was filled to maximum capacity, or beyond, the additional force exerted on the ring element made removal of the ring from the orifice difficult. Further, the increased stress on the locking ring element caused by cyclical insertion and removal caused breakage rendering the binder inoperable.

It is therefore, the object of the present invention to provided a ring-type binder that overcomes the defects and disadvantages of the prior art ring-type binders.

It is another object of the present invention to provide a improved ring-type binder that is simple in construction, easy to operate and durable.

It is a further object to provide an improved locking device that does not compromise the structural integrity of the ring elements or hinder the functioning of the binder.

These objects, together with other objects and advantages, will be apparent from the following disclosure of the present invention.

SUMMARY OF THE INVENTION

The present invention overcomes the disadvantages inherent in the above described prior art by providing a ring-type binder comprising a substantially smooth outer member, a partially open intermediate member having ring teeth, a substantially smooth inner member and a locking device to prevent unbinding.

The outer and inner members are generally semi-circular tubes concentrically secured to one another so that outer member overlies the inner. Each of the inner and outer members have substantially smooth inside and outside surfaces. The inner member is provided along its length with two segments of reduced thickness. The combination of the two segments, the outside surface of the inner member and the inside surface of the outer member, define two open areas or tracks along the length of the binder into which the intermediate ringed member is received.

The partially open ringed member is generally comb like in shape having a plurality of teeth along its length. The ring member may be slid between the inner and outer members and removed therefrom. In this manner, a user may disengage the ringed member from the other members to add or remove sheets of perforated paper.

A locking device comprising a semi-circular strip that is secured at one end to the underside of the inner member. This locking strip is configured so that a finger portion thereof would normally extend between two teeth of the ring member and thereby prevent the movement of the same. In this way, the binder may be placed in a locked position. Upon application by the user of a deformation force to the finger portion of the strip, the strip may be drawn from between the teeth thereby freeing the movement of the ring member and placing the binder in an open position.

Full details of the present invention are set forth in the following description and illustrated in the accompanying drawings.

DETAILED DESCRIPTION OF THE INVENTION

Figure 1:
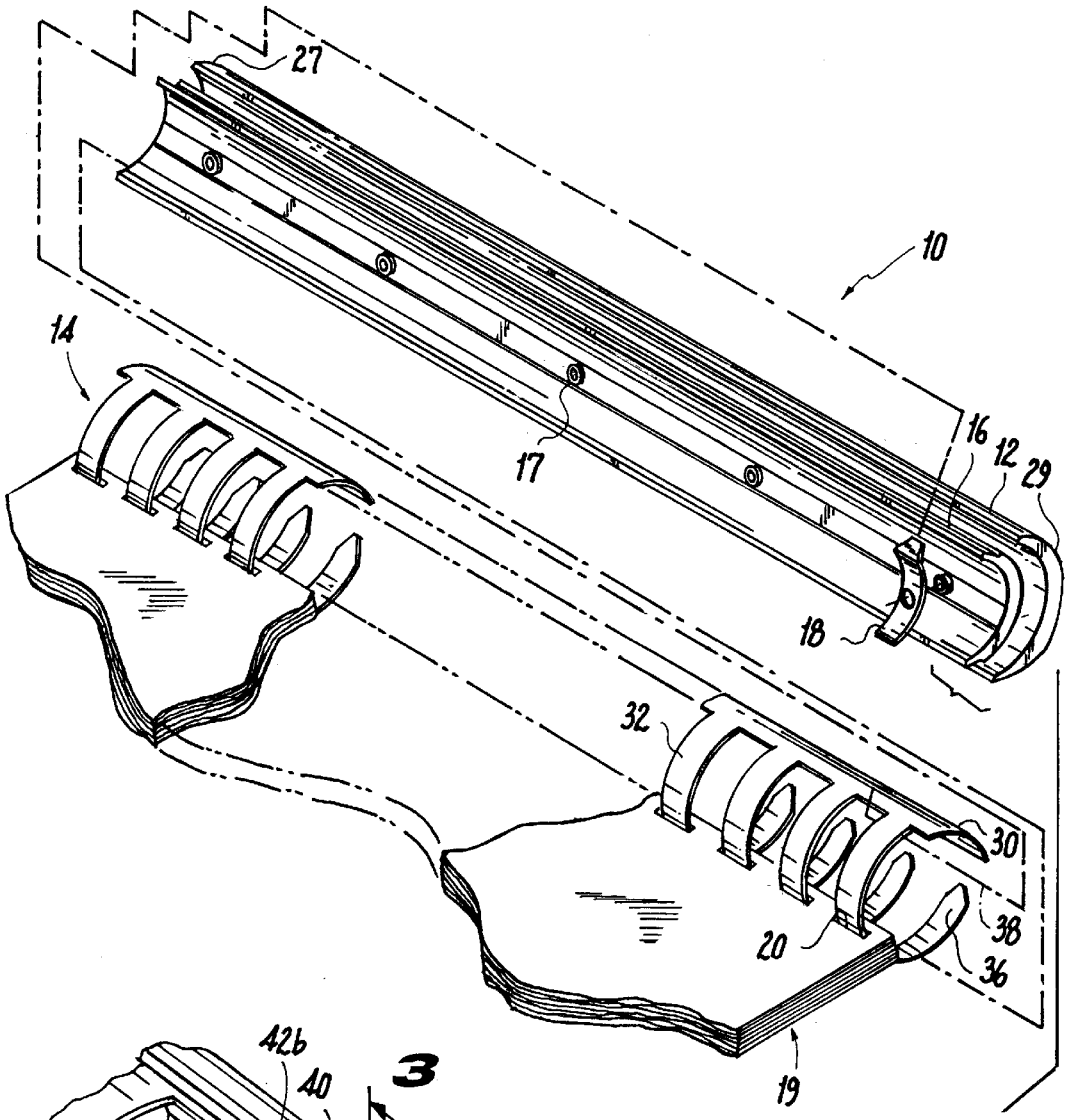
FIG. 1 is an exploded perspective view of a binder according to the present invention.

As seen in FIG. 1, the binder according to the present invention, generally depicted by the numeral 10 comprises a substantially smooth outer member 12, a conforming slidable intermediate ring member 14 and a substantially smooth inner member 16. A locking device 18 is attached to the inner member 16. The intermediate ring member 14 is adapted to be moved longitudinally relative to the other members from a open position to a closed binding position. When the binder 10 is in the closed binding position of FIG. 2 it is adapted to retain a plurality of perforated sheets 19.

Figure 2:
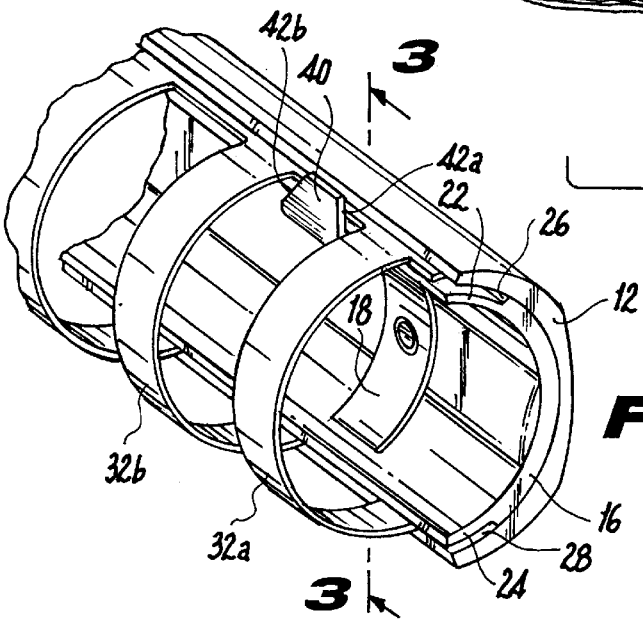
FIG. 2 is a perspective view of the binder in FIG. 1 shown in its assembled closed operative position.

The outer member 12 and inner member 16 are generally semi-circular in shape and are fixedly secured to one another so that outer member overlies the inner. Both the inner and outer members have generally smooth inside and outside surfaces. Outer member 12 and inner member 16 are secured using plastic rivets 17 or the like. As seen in FIG. 2, the inner member 16 is provided with two diametrically opposed segments 22 and 24 of reduced thickness. The combination of segments 22 and 24, the outside surface of the inner member and the inside surface of the outer member define two open areas or tracks 26 and 28 along the length of the binder. The open areas between the inner and outer members act to receive the intermediate ring member 14 and provide a track along which the intermediate member may slide from the open to the closed position. The tracks 26 and 28 extend along the full length of the binder including the leading and trailing ends 27 and 29 respectively. The leading end 27 may be provided with a flared shape to facilitate feeding of the ring element 14 into the tracks. The trailing end 29 may be left open to allow insertion and removal of the intermediate ring member 14 from either end of the binder or may be sealed to allow insertion and removal only from the leading end 27. The inner and outer members are preferably formed of a durable plastic material or the like, such as that used in this art.

The intermediate ring member 14 is intended to directly engage the perforations 20 and retain the sheets 19 in a bound position. Intermediate member 14 is formed in the general shape of a comb and has a continuous body 30. Teeth 32 are provided along the length of ring member 14 at spaced intervals. The ring member 14 is bent so that the teeth 32 are bent inward toward the body 30. The teeth 32 are provided with V-shaped ends 36 so as to allow the easy insertion and removal of the teeth in the perforations 20. The intermediate ring member 14 may be formed of any one of a number of materials having a memory, that is, a material that may be flexed but will return to its original shape after deformation. It is preferred that a durable plastic be utilized in the manufacture of the intermediate member 14.

As seen in FIG. 1, the teeth 32 terminate short of a full circle, that is, before reaching the longitudinal rear edge of the body 30, thereby defining a gap 38. The space 38 allows the user to easily insert or remove pages when the binder is in the open position. The gap 38 also enables the intermediate ring member to be inserted into the tracks 26 and 28. The dimension of the intermediate member should be such that it partially wraps around the inner member thereby engages the same while at the same time allowing smooth longitudinal movement of the respective members. When in the closed position, inner member 12 and outer member 16 serve to bridge the gap 38 and to secure the teeth 32 and prevent unbinding.

The binder is provided with a locking device 18 for locking the binder in the closed binding position thereby insuring the secure retention of the sheets 19 when the binder is in the bound position. Further, the locking device allows the user to selectively unlock the binder so as to permit the movement of the intermediate members 14, thereby placing the binder in the open position and permitting the addition of pages or removal of the same.

Figure 3:
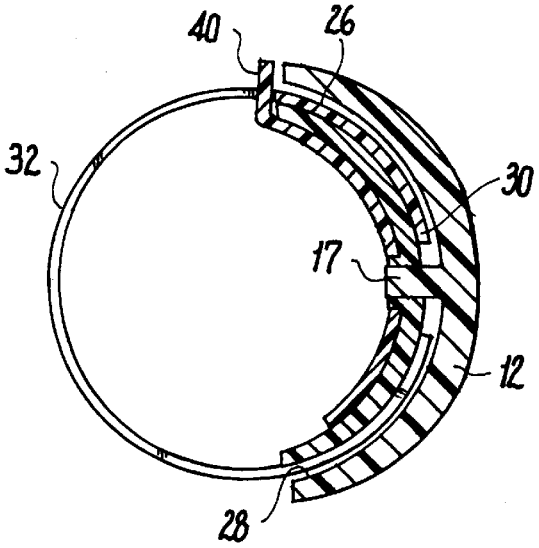
FIG. 3 is a sectional view of the binder in FIG. 2 taken along line 3—3.

As seen in FIGS. 2 and 3, the locking device 18 comprises a generally semi-circular plastic strip fixedly secured to the underside of the inner member 16 by a plastic rivet or the like. Alternatively, the plastic strip may be secured in any other conventional manner, such as by sonic welding or by adhesive. If desired, the strip may be reinforced with additional securement means such as support members, ribs or the like. The strip is provided with a substantially vertical tongue 40 that extends between adjacent teeth 32*a* and 32*b* when the binder is in the closed position. When in the closed position, the tongue 40 lies between the teeth thereby preventing the longitudinal movement of the binder members.

Figure 4:
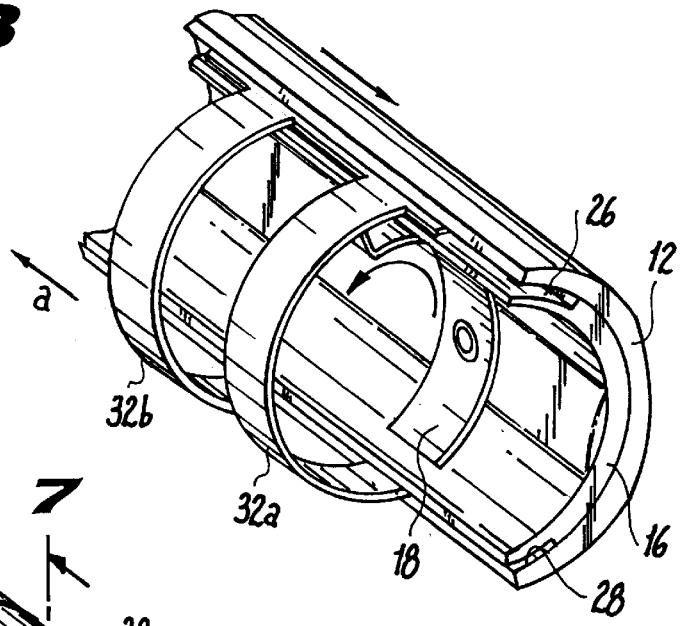
FIG. 4 is a perspective view of the binder in FIG. 1 showing the relative movement of the binder members.
Figure 5:
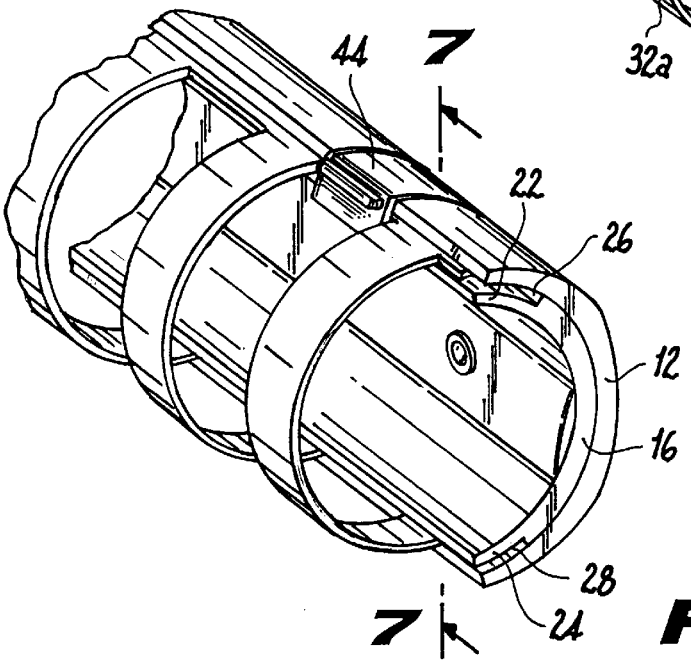
FIG. 5 is a perspective view of a alternate embodiment of the present invention.

Upon the application of a force sufficient to deform the locking device 18, the locking device will flex under tooth 32*a,* as shown in FIG. 4. By so flexing the locking device under tooth 32*a* and simultaneously longitudinally sliding the ring member 14 in the direction "a" the plastic strip can be placed in position outside tooth 32*a*. When the locking device is placed outside tooth 32*a* the binder members can be moved freely, placing the binder in the open position.

It is preferable that the locking device 18 is secured on to the inner member so that when the binder in the closed locked position the locking element lies between the two outermost teeth, i.e. between teeth 32*a* and 32*b*. This position facilitates easiest separation of the binder members. Thus, when the locking element 18 is placed in this location, the user only needs to negotiate the locking device around one tooth, i.e. 32*a,* to place the binder in the open position. Similarly, to arrange the binder in the closed locked position the user can simply slide the binder members together and flex the locking element 18 to place it between teeth 32*a* and 32*b*.

As described above, the locking element is provided with substantially vertical tongue 40 that extends between the ring elements 32. As seen in FIG. 2, the tongue 40 is preferably provided with a vertical side wall 42*a* and an angled side wall 42*b*. The angled side wall 42*b* assists in locking the binder by causing the locking element to automatically deflect when it comes in contact with tooth 32*a* during the longitudinal movement of the binder members. Thus when the user closes the binder by longitudinally moving the binder members the locking device 18 automatically slides under tooth 32*a* and engages between teeth 32*a* and 32*b* without manual manipulation of the locking element by the user. The vertical side wall 42*a* provides the necessary resistance to prevent the unintentional unbinding.

Figure 6:
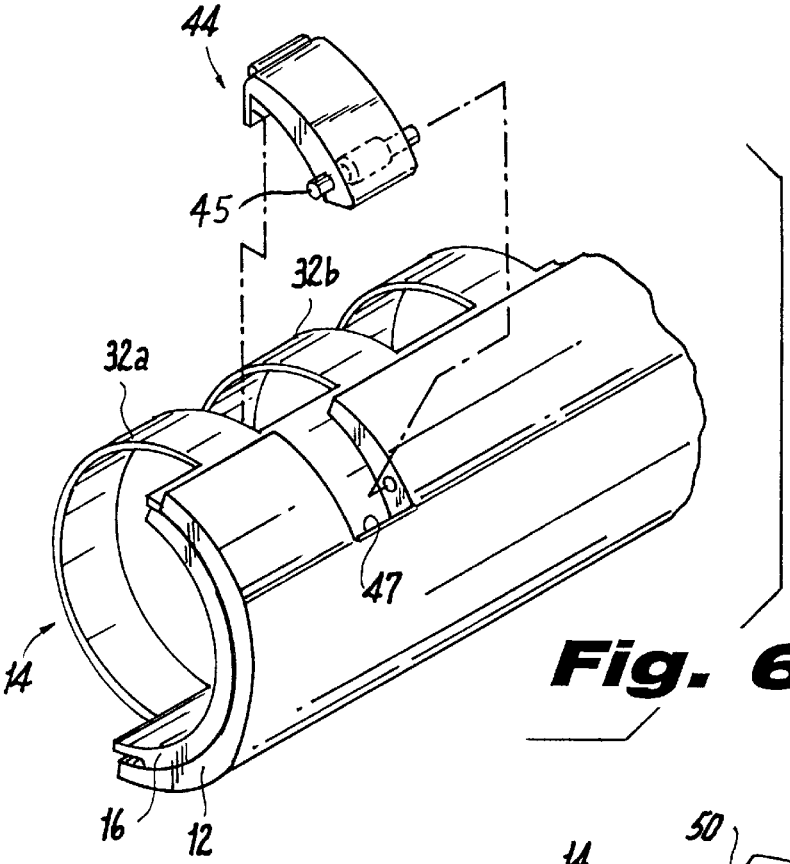
FIG. 6 is a exploded perspective view of the binder in FIG. 5.

An alternate embodiment of the binder according to the present invention is shown in FIGS. 5 through 8. The binder depicted in FIGS. 5 through 8 is identical to the binder described above in structure and function except for the locking device. The locking element 44 of the alternate embodiment, as best seen in FIG. 6, comprises an overlapping shoulder member that is pivotally connected at one end by pin 45 so as to allow radial movement of the other end. The pin 45 is received by two selectively placed holes in the outer member 12. The shoulder member is shaped so as to be received by a cavity provided in outer member 12. The outer member can be provided with a cut back section 47 to minimize any interference with the locking element 44 during the rotation of the same. Other methods may be used to minimize interference with the locking element during rotation and will be apparent to those skilled in the art. As seen, the shoulder member is curved so as to provide a smooth continuous appearance with the outer member.

Figure 7:
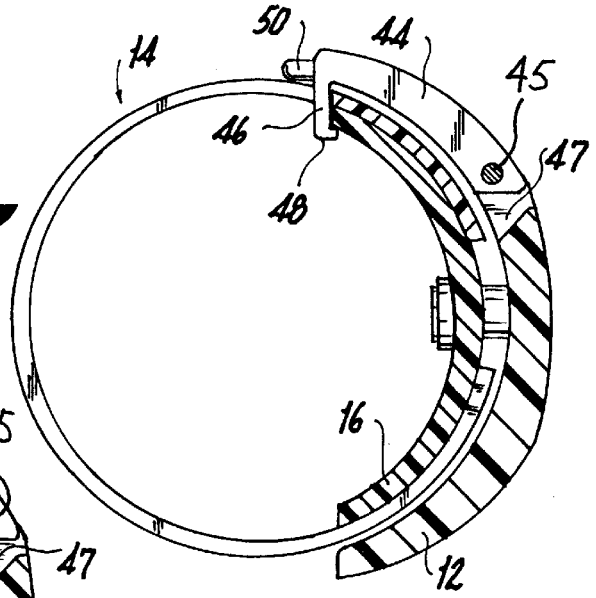
FIG. 7 is a sectional view of the binder in FIG. 5 taken along line 7—7.

As best seen in FIG. 7, the shoulder member is provided with a substantially vertical portion 46 that extends down and between adjacent rings 32*a* and 32*b*. Vertical portion 46 has a substantially horizontal lip 48 that wraps under and engages the inner member 16 so as to secure the shoulder in a locked position. In this way, the user may rotate the shoulder between the adjacent ring members and secure it between the same, thereby preventing the longitudinally displacement of the binder members and placing the binder in a closed position.

Figure 8:
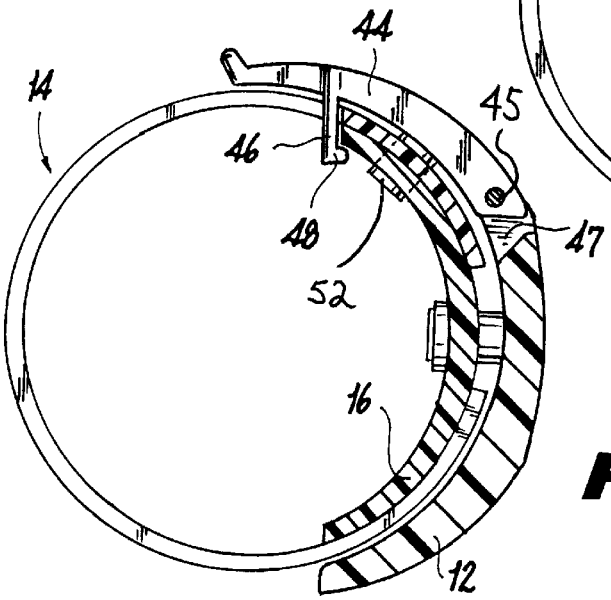
FIG. 8 depicts a variation of the locking device according the alternate embodiment of the present invention.

The shoulder 44 is also provided with a tab 50 that allows the user to exert an upward force upon the shoulder with a thumb or finger to thereby release the shoulder from a locked position. The tab 50 may be small as shown in FIG. 7 or large as shown in FIG. 8. By applying a vertical force on the tab 50 the user can release the shoulder, rotate the shoulder away from and between the ring members thereby permitting the longitudinal movement of the binder members and placing the binder in a open position.

As seen in FIG. 8, the shoulder 44 may also be provided with a post 52 to provide additional security against longitudinal displacement. The post 52, as shown, is inserted in a hole in outer member 12, intermediate member 14 and inner member 16. The post further serves to insure that unwanted longitudinal displacement is avoided.

As seen from the foregoing, an improved ring-type binder has been provided that is simple in construction, that is easy to operate and durable. Further, a locking device has been provided that does not compromise the structural integrity of the ring elements nor otherwise interfere with the function of the binder.

The foregoing description has been presented for purposes of illustration and description. It is not intended to be exhaustive or to limit the invention to the precise form disclosed. Obvious modifications are possible in light of the above teaching without departing from the spirit of the invention.

What is claimed is:

1. A ring type binder comprising an inner member having an inner surface, an outer member and a generally cylindrical intermediate member, each of said inner and outer members having elongated bodies arcuate in cross section and terminating in straight longitudinal edges, said elongated bodies being coaxially fixedly secured together and formed to define a continuous slot along each of said longitudinal edges, said intermediate member having a straight first edge and a second opposed edge provided with a plurality of teeth extending arcuately therefrom, said intermediate member slidably received within said inner and outer member, the first edge lying in one slot and the teeth lying in the other slot, said ring type binder further comprising a locking device having a first end, a second end, a locked position, and a unlocked position, said locking device secured at at said first end to said inner surface of said inner member and said second end of said strip normally extending between a pair of adjacent teeth preventing longitudinal movement of said intermediate member relative to said inner and outer members when said locking device is in said locked position and said second end movable from said locked position to said unlocked position wherein said second end is disengaged from between said pair of adjacent teeth permitting longitudinal movement of said intermediate member relative to said inner and outer members.

2. A ring type binder as claimed in claim 1, said inner member having along each of its longitudinal edges sections of reduced thickness relative to the remainder of said inner member.

3. A ring type binder as claimed in claim 1, said second end having a substantially vertical portion.

4. A ring type binder as claimed in claim 3, said vertical portion having one angled side wall and one vertical side wall.

5. A ring type binder as claimed in claim 1, each of said plurality of teeth having a v-shaped end.

6. A ring type binder comprising an inner member, an outer member, and a generally cylindrical intermediate member, each of said inner and outer members having elongated bodies arcuate in cross section and terminating in straight longitudinal edges, said elongated bodies being fixedly coaxially secured together and formed to define a continuous slot along each of said longitudinal edges, said intermediate member having a straight first edge and a second opposed edge provided with a plurality of teeth extending arcuately therefrom, said intermediate body slidably received within said inner and outer member, the first edge lying in one slot and the teeth lying in the other slot, said ring type binder further comprising a locking device having a generally curved body with first and second ends, said first end having means for connecting said locking device to said outer member and allowing the radial movement of said second end from a locked position between a pair of adjacent teeth preventing longitudinal movement of said intermediate member relative to said inner and outer members to an unlocked position permitting the longitudinal movement of said intermediate member relative to said inner and outer members.

7. The ring type binder as claimed in claim 6, wherein said second end includes means for engaging said inner member when said locking device is in said locked position.

8. A ring type binder comprising an inner member, an outer member, and a generally cylindrical intermediate member, each of said inner and outer members having elongated bodies arcuate in cross section and terminating in straight longitudinal edges, said elongated bodies being fixedly coaxially secured together and formed to define a continuous slot along each of said longitudinal edges, said intermediate member having a straight first edge and a second opposed edge provided with a plurality of teeth extending arcuately therefrom, said intermediate body slidably received within said inner and outer member, the first edge lying in one slot and the teeth lying in the other slot, said ring type binder further comprising a locking device having a locked position wherein said locking device extends between a pair of adjacent teeth preventing the longitudinal movement of said intermediate member relative to said inner and outer members and a unlocked position wherein said locking device is removed from between said pair of adjacent teeth permitting the longitudinal movement of said intermediate member relative to said inner and outer members.

9. A ring type binder as claimed in claim 8, wherein said locking is manually alternately adjustable between said locked and unlocked positions to permit a user to adjust said ring type binder between a locked and a unlocked state.

* * * * *